US007552802B2

(12) United States Patent
Hirade

(10) Patent No.: US 7,552,802 B2
(45) Date of Patent: Jun. 30, 2009

(54) CONTROLLER FOR ELEVATOR

(75) Inventor: Masaaki Hirade, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 448 days.

(21) Appl. No.: 11/587,579

(22) PCT Filed: Jul. 8, 2004

(86) PCT No.: PCT/JP2004/009716

§ 371 (c)(1),
(2), (4) Date: Oct. 25, 2006

(87) PCT Pub. No.: WO2006/006205

PCT Pub. Date: Jan. 19, 2006

(65) Prior Publication Data

US 2007/0240944 A1 Oct. 18, 2007

(51) Int. Cl.
*B66B 1/34* (2006.01)

(52) U.S. Cl. ..... 187/396; 187/383

(58) Field of Classification Search ..... 187/247, 187/248, 380–388, 391–396
See application file for complete search history.

(56) References Cited

U.S. PATENT DOCUMENTS

| | | | | |
|---|---|---|---|---|
| 4,852,696 A | | 8/1989 | Fukuda et al. | |
| 5,022,497 A | * | 6/1991 | Thanagavelu | 187/382 |
| 5,290,976 A | * | 3/1994 | Bahjat et al. | 187/295 |
| 5,331,121 A | * | 7/1994 | Tsuji | 187/388 |
| 5,345,049 A | * | 9/1994 | Bahjat et al. | 187/382 |
| 5,354,957 A | * | 10/1994 | Robertson | 187/247 |
| 5,551,533 A | * | 9/1996 | Ng | 187/391 |
| 5,892,190 A | * | 4/1999 | Morita et al. | 187/382 |
| 6,945,365 B2 | * | 9/2005 | Matela | 187/382 |

FOREIGN PATENT DOCUMENTS

| | | |
|---|---|---|
| JP | 48 58546 | 8/1973 |
| JP | 5 319704 | 12/1993 |
| JP | 6 40675 | 2/1994 |
| JP | 7 277623 | 10/1995 |
| JP | 2502077 | 5/1996 |
| JP | 11 92045 | 4/1999 |
| JP | 2000 226166 | 8/2000 |
| JP | 2001 139248 | 5/2001 |

OTHER PUBLICATIONS

U.S. Appl. No. 11/587,579, filed Oct. 25, 2006, Hirade.
U.S. Appl. No. 11/817,516, Aug. 31, 2007, Hirade.

* cited by examiner

*Primary Examiner*—Jonathan Salata
(74) *Attorney, Agent, or Firm*—Oblon, Spivak, McClelland, Maier & Neustadt, P.C.

(57) ABSTRACT

Provided is an elevator control apparatus in a building in which a plurality of elevators are installed, the apparatus including: a congestion information detecting means (1B1) for detecting a landing area congestion state at each story floor and in each operating direction of all the elevators and generating congestion degree information about the entire building based on the landing area congestion state; a service state detecting means (1B2) for measuring waiting time for landing area call registrations at all the elevators, calculating an average value of the waiting time, and generating service state information about the entire building based on the average value; and a guidance display means (1B3) for displaying the congestion degree information and the service state information.

4 Claims, 5 Drawing Sheets

CONTROLLER FOR ELEVATOR

TECHNICAL FIELD

The present invention relates to an elevator control apparatus, and more particularly, to an elevator control apparatus that provides a display serving as guidance for customers.

BACKGROUND ART

As regards a display serving as guidance in a boarding zone of an elevator, there has been proposed, for example, an elevator control apparatus that displays information on the position of a car of the elevator, the length of waiting time, and the like in order to allay the irritation of customers waiting for the elevator which has been taking a long time to arrive.

For instance, there has been proposed an elevator control apparatus having a guidance display unit, which is provided in a boarding zone of an elevator to display information on the position of a car of the elevator, the traveling direction of the elevator, the average length of waiting time, the number of passengers, and the like (e.g., see Patent Document 1).

There has also been proposed an elevator control apparatus that displays a combination of information on an elevator (position of a car thereof and the like) and general information useful to customers who are about to go out (information on the weather forecast, transportation facilities, and the like) (e.g., see Patent Document 2).

Patent Document 1: JP 2502077 A

Patent Document 2: JP HEI 11-92045 A

DISCLOSURE OF THE INVENTION

Problem to be Solved by the Invention

In each of these conventional elevator control apparatuses, however, only the operating condition of the single car is displayed, so the customers cannot grasp how crowded an entire building is. Accordingly, there is a problem in that the waiting customers cannot determine, for example, whether only the car of the elevator they are waiting for happens to be hindered from being operated smoothly for some reason or the length of waiting time for the elevator has increased because of the crowdedness of the entire building.

The present invention has been made to solve the problem discussed above, and it is therefore an object of the invention to obtain an elevator control apparatus which can understandably display as guidance the flow of traffic (flow of passengers) in an entire building and the service state of elevators in the entire building.

Means for Solving the Problems

The present invention provides an elevator control apparatus in a building in which a plurality of elevators are installed, including: crowdedness information detecting means for detecting states of crowdedness in boarding zones on respective floors and in respective traveling directions as to all the elevators and generating information on a degree of crowdedness in the entire building based on the states of crowdedness in the boarding zones; service state detecting means for measuring lengths of waiting time for boarding zone call registrations in all the elevators, calculating an average of the lengths of waiting time, and generating information on a service state in the entire building based on the average; and guidance display means for displaying the information on the degree of crowdedness and the information on the service state.

Effect of the Invention

The present invention relates to an elevator control apparatus in a building in which a plurality of elevators are installed, including: crowdedness information detecting means for detecting states of crowdedness in boarding zones on respective floors and in respective traveling directions as to all the elevators and generating information on a degree of crowdedness in the entire building based on the states of crowdedness in the boarding zones; service state detecting means for measuring lengths of waiting time for boarding zone call registrations in all the elevators, calculating an average of the lengths of waiting time, and generating information on a service state in the entire building based on the average; and guidance display means for displaying the information on the degree of crowdedness and the information on the service state. With this, the states of crowdedness in the boarding zones on the respective floors and in the respective traveling directions in all the elevators are detected, and the information on the degree of crowdedness in the entire building is generated based on the states of crowdedness in the boarding zones. The lengths of waiting time for the call registrations in the boarding zones of all the elevators are measured, and the average of the lengths of waiting time is calculated. The information on the service state in the entire building is generated based on the average, and the information on the degree of crowdedness in the entire building and the information on the service state in the entire building are understandably displayed as guidance. Therefore, customers can immediately grasp the flow of traffic (the flow of passengers) in the entire building and the service state of the elevators in the entire building.

BEST MODE FOR CARRYING OUT THE INVENTION

Figure 1:
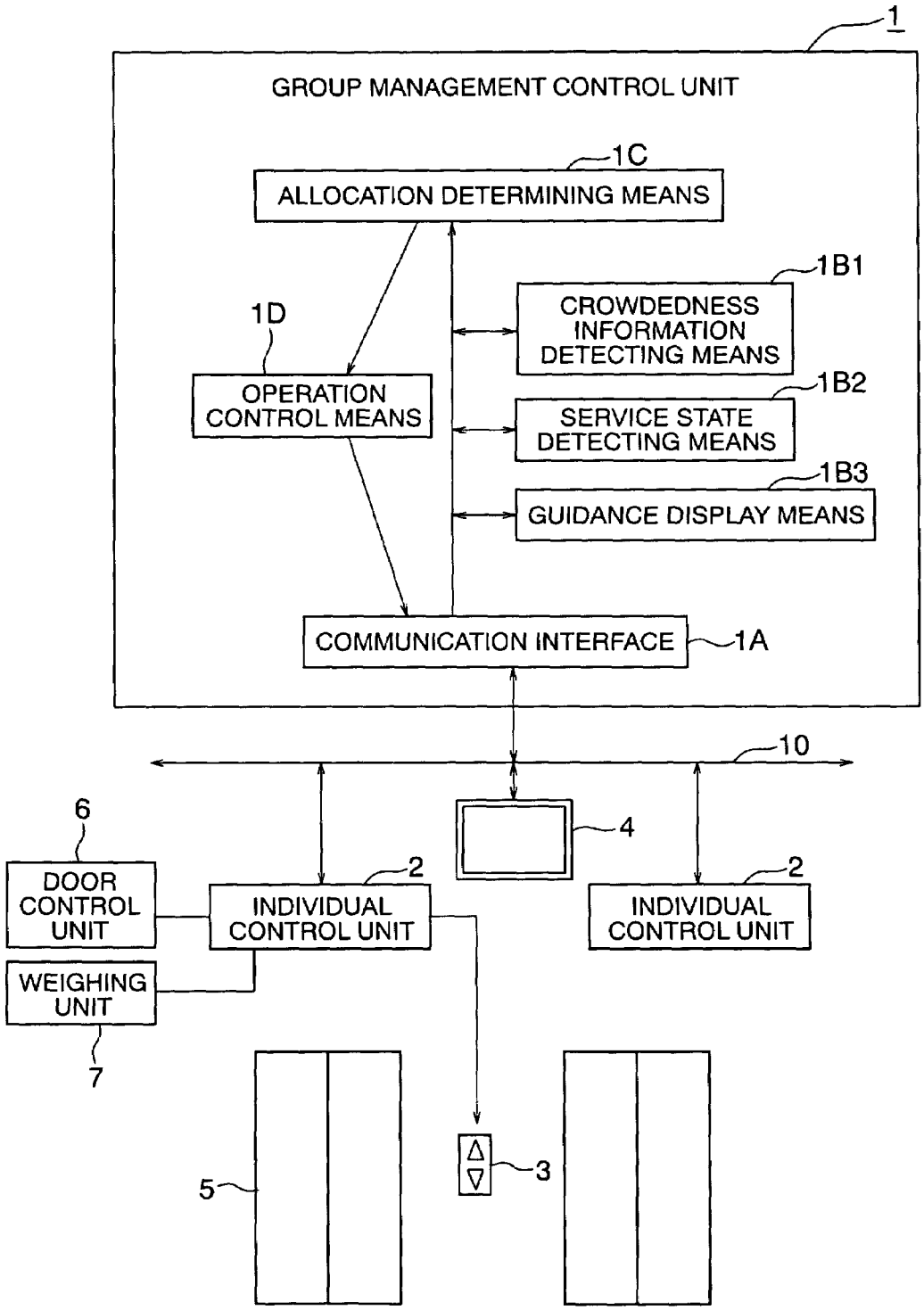
FIG. 1 is a schematic diagram showing the entire configuration of an elevator control apparatus according to the present invention.

FIG. 1 shows the configuration of an entire system of an elevator control apparatus according to the present invention. As shown in FIG. 1, a plurality of individual control units 2 are connected to a group management control unit 1 via a network 10 in a building. The group management control unit 1 is a control unit for managing/controlling a plurality of cars efficiently. The individual control units 2, which are provided for the respective cars on a one-to-one basis, control the operations of the respective cars based on an operational command from the group management control unit 1.

Each of boarding zone call registration units 3 installed in boarding zones is connected to a corresponding one of the individual control units 2. As shown in FIG. 1, each of the boarding zone call registration units 3 is provided with an UP button (an up button: button for registering a boarding zone call for an upward direction) and a DN button (a down button: button for registering a boarding zone call for a downward direction). When a customer depresses the UP button or the DN button, information on a boarding zone call is transmitted to the group management control unit 1 via the corresponding one of the individual control units 2. Each of door control units 6 for controlling the opening/closing operations of car doors 5 of the elevators respectively is also connected to a corresponding one of the individual control units 2. In addition, each of weighing units 7 for detecting weights in cars of the elevators respectively is connected to a corresponding one of the individual control units 2.

For the sake of simplification of illustration, FIG. 1 shows only one or two of the individual control units 2, the boarding zone call registration units 3, the car doors 5, the door control units 6, and the weighing units 7. In fact, however, the numbers of the individual control units 2, the boarding zone call registration units 3, the car doors 5, the door control units 6, and the weighing units 7 are each equal to the number of the elevators.

A guidance display unit 4 designed as a liquid-crystal display unit or the like is connected to the network 10 in the building. The guidance display unit 4 displays the flow of passengers in the entire building and a service state of the elevators in the entire building (see FIG. 6).

Next, the internal configuration of the group management control unit 1 will be described. A communication interface (1A) is provided in the group management control unit 1. The communication interface (1A) is designed to communicate with the individual control units 2 or the guidance display unit 4 via the network 10 in the building. Crowdedness information detecting means (1B1) is provided in the group management control unit 1. The crowdedness information detecting means (1B1) detects states of crowdedness in the boarding zones on respective floors and in respective traveling directions, and generates information on crowdedness based on the detected states of crowdedness. Service state detecting means (1B2) is also provided in the group management control unit 1. The service state detecting means (1B2) detects lengths of waiting time for boarding zone call registrations in the boarding zones on all the floors and in the respective traveling directions, and generates information on a service state based on the detected lengths of waiting time. Guidance display means (1B3) is also provided in the group management control unit 1. The guidance display means (1B3) performs a processing of causing the guidance display unit 4 to display information transmitted from the crowdedness information detecting means (1B1) and the service state detecting means (1B2). Allocation determining means (1C) for determining cars to be allocated through calculation is also provided in the group management control unit 1. In addition, operation control means (1D) is provided in the group management control unit 1. The operation control means (1D) issues an operational command to each of the individual control units 2 in accordance with a calculation result obtained by the allocation determining means (1C).

Next, operations will be described.

The outline of the operations will be described first, and details thereof will be described later.

The crowdedness information detecting means (1B1) calculates passenger unloading loads and passenger loading loads of the respective cars (detection of passenger loading/unloading loads). Then, the crowdedness information detecting means (1B1) generates information on the degree of crowdedness in the entire building based on the passenger unloading loads and the passenger loading loads on the respective floors and in the respective traveling directions on a certain cycle (detection of information on the degree of crowdedness).

On the other hand, the service state detecting means (1B2) measures lengths of waiting time for the respective cars in the respective traveling directions as to all the boarding zone call registrations (detection of lengths of waiting time). Then, the service state detecting means (1B2) calculates an average length of waiting time for the respective boarding zone call registrations on a certain cycle based on the measured lengths of waiting time, and generates information on the service state in the entire building based on the average length of waiting time (detection of a service state).

The guidance display means (1B3) acquires the information on the degree of crowdedness in the entire building from the crowdedness information detecting means (1B1), and acquires the information on the service state from the service state detecting means (1B2). The guidance display means (1B3) transmits the acquired information on the degree of crowdedness and the acquired information on the service state from the communication interface 1A to the guidance display unit 4 via the network 10 in the building, thereby causing the guidance display unit 4 to display those pieces of information. The contents displayed by the guidance display unit 4 are updated as soon as updated information on the degree of crowdedness and updated information on the service state are transmitted thereto.

Next, the operations will be described in detail.

(I) First of all, the operation of detecting passenger loading/unloading loads will be described.

The weighing units 7 are installed in the cars, respectively, to measure a total weight in each of the cars from a moment when a door thereof is opened to a moment when the door thereof is closed. Using a result of the measurement, the crowdedness information detecting means (1B1) calculates a car load, a passenger loading load, and a passenger unloading load according to the following method.

car load [%] in opening door=100×weight in opening door/maximum laden weight of car car load [%] in closing door=100×weight in closing door/maximum laden weight of car passenger unloading load [%]=100×(weight in opening door−weight in ending the unloading of passengers)/maximum laden weight of car passenger loading load [%]=100×(weight in closing door−weight in starting the loading of passengers)/maximum laden weight of car The aforementioned pieces of information are stored into a storage device (not shown) in the group management control unit 1, together with an hour of occurrence, a floor of occurrence, and a direction of occurrence (a direction in which the car is traveling).

(II) Next, the operation of detecting information on the degree of crowdedness will be described.

The crowdedness information detecting means (1B1) checks passenger loading loads and passenger unloading loads on the respective floors and in the respective traveling directions in the past as to all the cars on a certain cycle (e.g., at intervals of one minute), and acquires information on the degree of crowdedness in the entire building according to the following method. It should be noted herein that an UP direction indicates an upward traveling direction of an elevator, that a DN direction indicates a downward traveling direction of an elevator, and that an N-th floor indicates each of the floors (1≦N≦a number indicating an uppermost floor).

(1) In a case where there has been established a state, in which (a) the car load in opening the door is equal to or larger than 70% (a first threshold) and (b) the passenger unloading load is equal to or larger than 30% (a second threshold), three or more times in a row in the UP direction and on the N-th floor, the crowdedness information detecting means (1B1) determines the information on the degree of crowdedness as "crowdedness in the upward direction and crowdedness in unloading passengers on the N-th floor".

(2) In a case where there has been established a state, in which (a) the car load in opening the door is equal to or larger than 70% (the first threshold) and (b) the passenger unloading load is equal to or larger than 30% (the second threshold), three or more times in a row in the DN direction and on the N-th floor, the crowdedness information detecting means (1B1) determines the information on the degree of crowdedness as "crowdedness in the downward direction and crowdedness in unloading passengers on the N-th floor".

(3) In a case where there has been established a state, in which (a) the car load in closing the door is equal to or larger than 70% (a third threshold) and (b) the passenger loading load is equal to or larger than 30% (a fourth threshold), three or more times in a row in the UP direction and on the N-th floor, the crowdedness information detecting means (1B1) determines the information on the degree of crowdedness as "crowdedness in the upward direction and crowdedness in loading passengers on the N-th floor".

(4) In a case where there has been established a state, in which (a) the car load in closing the door is equal to or larger than 70% (the third threshold) and (b) the passenger loading load is equal to or larger than 30% (the fourth threshold), three or more times in a row in the DN direction and on the N-th floor, the crowdedness information detecting means (1B1) determines the information on the degree of crowdedness as "crowdedness in the downward direction and crowdedness in loading passengers on the N-th floor".

If there are a plurality of cases corresponding to each of the aforementioned cases (1) to (4), the information on the degree of crowdedness is provided based on that one of the cases in which the sum of the values (a) and (b) is maximized. If there is no case corresponding to any one of the aforementioned cases (1) to (4), no information on the degree of crowdedness is provided.

Although three is set as a predetermined number of times in the aforementioned cases (1) to (4), the present invention should not be limited thereto. That is, an arbitrary number can be set appropriately as the predetermined number of times. Although 70% and 30% are set as the predetermined thresholds, the present invention should not be limited thereto. That is, arbitrary values can be set appropriately as the predetermined thresholds in accordance with the environment for use, the specification of the elevators, and the like.

Figure 2:
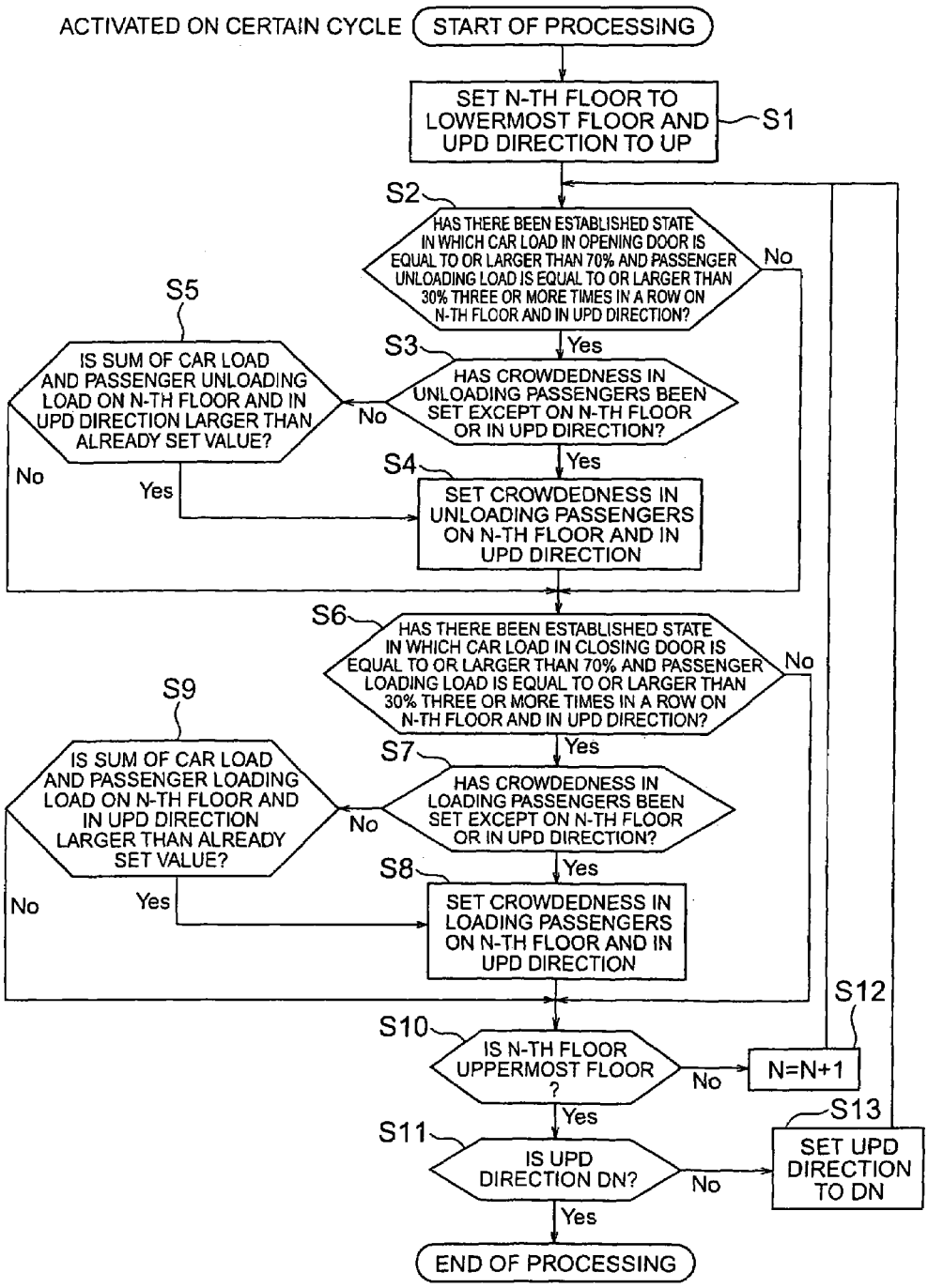
FIG. 2 is a flowchart showing the flow of a processing of a degree-of-crowdedness information detecting operation in the elevator control apparatus according to the present invention.

A more detailed description will be given with reference to FIG. 2. FIG. 2 is a flowchart showing the flow of the processing of the aforementioned degree-of-crowdedness information detecting operation.

First of all, the N-th floor is set as the lowermost floor, and the traveling direction of the elevator is set as the UP direction (step S1). It is then determined whether or not the state in which (a) the car load in opening the door is equal to or larger than 70% and (b) the passenger unloading load is equal to or larger than 30% has been established three or more times in a row (step S2). When it is determined in step S2 that both the conditions (a) and (b) have been fulfilled, a transition to step S3 is made. It is determined in step S3 whether or not crowdedness in unloading passengers has been set except on the N-th floor or in the UP direction (step S3). When crowdedness in unloading passengers has been set, a transition to step S4 is made to set crowdedness in unloading passengers on the N-th floor and in the UP direction. Then, a transition to step S6 is made.

On the other hand, when it is determined in step S2 that one of the conditions (a) and (b) has not been fulfilled, a transition to later-described step S6 is made.

When it is determined in step S3 that crowdedness in unloading passengers has not been set except on the N-th floor or in the UP direction, a transition to step S5 is made. It is determined in step S5 whether or not the sum of the car load and the passenger unloading load on the N-th floor in the UP direction is larger than an already set value (step S5). When it is determined in step S5 that the sum is larger than the already set value, a transition to step S4 is made. On the other hand, when it is determined in step S5 that the sum is not larger than the already set value, a transition to step S6 is made.

It is determined in step S6 whether or not the state in which (a) the car load in closing the door is equal to or larger than 70% and (b) the passenger loading load is equal to or larger than 30% has been established three or more times in a row on the N-th floor and in the UP direction (step S6). When it is determined in step S6 that both the conditions (a) and (b) have been fulfilled, a transition to step S7 is made. It is determined in step S7 whether or not crowdedness in loading passengers has been set except on the N-th floor or in the UP direction (step S7). When crowdedness in loading passengers has been set except on the N-th floor or in the UP direction, a transition to step S8 is made to set crowdedness in loading passengers on the N-th floor and in the UP direction (step S8). Then, a transition to step S10 is made.

On the other hand, when it is determined in step S6 that one of the conditions (a) and (b) has not been fulfilled, a transition to later-described step S10 is made.

When it is determined in step S7 that crowdedness in unloading passengers has not been set except on the N-th floor or in the UP direction, a transition to step S9 is made. It is determined in step S9 whether or not the sum of the car load and the passenger loading load on the N-th floor and in the UP direction is larger than an already set value (step S5). When it is determined in step S5 that the sum is larger than the already set value, a transition to step S8 is made. On the other hand, when it is determined in step S5 that the sum is not larger than the already set value, a transition to step S10 is made.

It is determined in step S10 whether or not the N-th floor is the uppermost floor (step S10). When the N-th floor is not the uppermost floor, the value of N is increased by 1 (step S12) and a return to the aforementioned step S2 is made. On the other hand, when the N-th floor is the uppermost floor, a transition to step S11 is made. It is determined in step S11 whether or not the traveling direction of the elevator is the DN direction. When the traveling direction of the elevator is the DN direction, the processing is ended. When the traveling direction of the elevator is not the DN direction, it is set to the DN direction (step S13). Then, a return to step S2 is made.

This processing is repeatedly performed on a certain cycle.

As described above, the crowdedness information detecting means (1B1) performs the aforementioned (I) "passenger loading/unloading load detecting operation" and the aforementioned (II) "degree-of-crowdedness information detecting operation", thereby generating information on the degree of crowdedness in the entire building.

(III) Next, the waiting time length detecting operation will be described.

The service state detecting means (1B2) measures a required length of time (a length of waiting time) from the occurrence of a call in a boarding zone in the UP direction (the upward direction) or the DN direction (the downward direction) to the arrival of a car in the boarding zone on the floor on which the call has been made individually for each of the floors and each of the cars, as to all the boarding zone call registrations. The measured length of waiting time is stored into the storage device (not shown) in the group management control unit 1, together with an hour of the arrival of the car in the boarding zone on the floor on which the call has been made.

(IV) Next, the service state detecting operation will be described.

The service state detecting means (1B2) performs the following processing on a certain cycle (e.g., at intervals of one minute). That is, the service state detecting means (1B2) measures lengths of waiting time in all the boarding zone call registrations which have been measured for the past five minutes, and calculates an average thereof (an average length of waiting time). Then, using this average, the service state detecting means (1B2) acquires information on the service state according to the following criteria.

(a) When the average length of waiting time is equal to or longer than 0 second and shorter than 20 seconds, the service state is very good.

(b) When the average length of waiting time is equal to or longer than 20 seconds and shorter than 25 seconds, the service state is good.

(c) When the average length of waiting time is equal to or longer than 25 seconds and shorter than 30 seconds, the service state is normal.

(d) When the average length of waiting time is equal to or longer than 30 seconds, the service state has deteriorated.

Although 20 seconds (a fifth threshold), 25 seconds (a sixth threshold), and 30 seconds (a seventh threshold) have been set as predetermined thresholds herein, the present invention should not be limited to this case. That is, arbitrary values can be set appropriately as the predetermined thresholds in accordance with the environment for use and the like.

Figure 3:
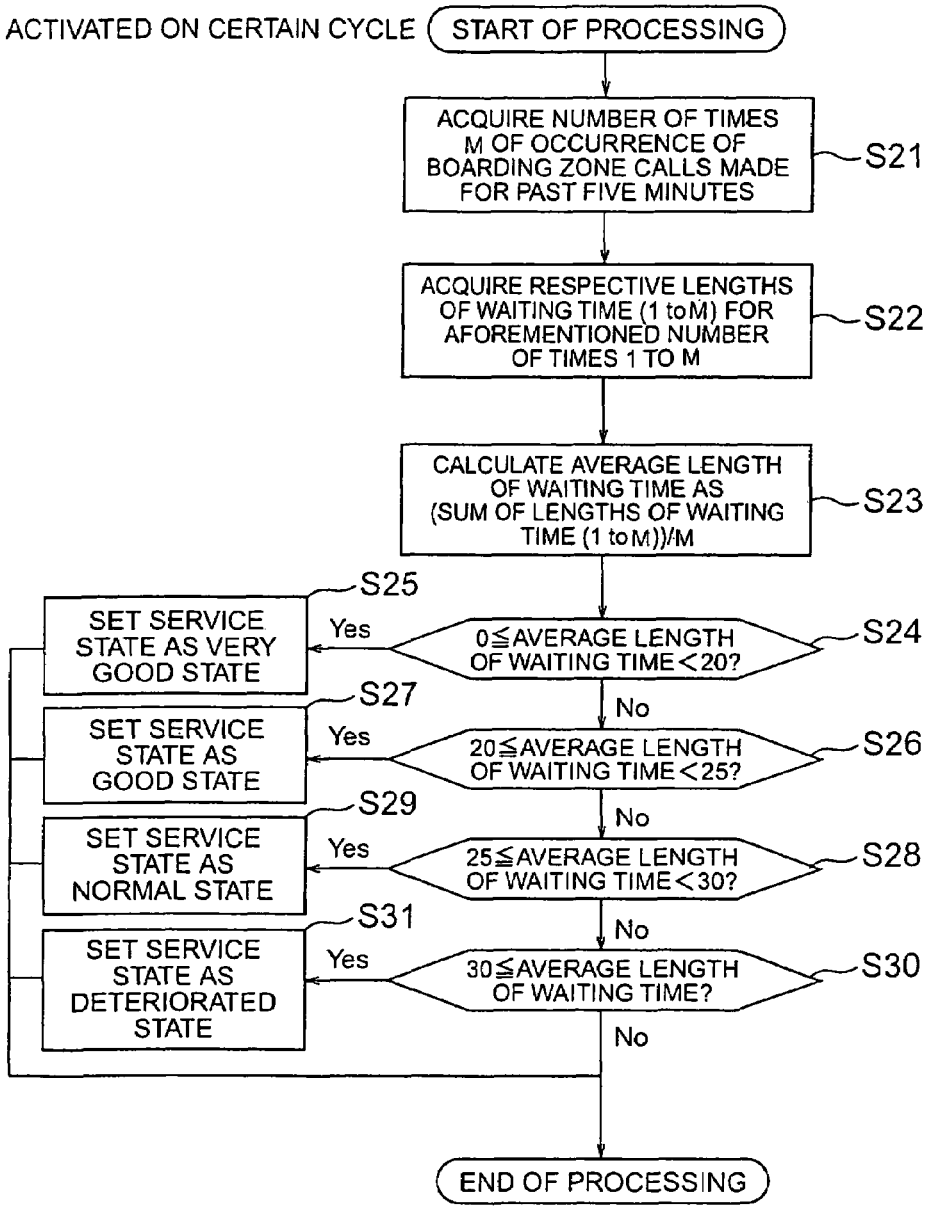
FIG. 3 is a flowchart showing the flow of a processing of a service state detecting operation in the elevator control apparatus according to the present invention.

A more detailed description will be given with reference to FIG. 3. FIG. 3 is a flowchart showing the flow of the processing of the aforementioned service state detecting operation.

First of all, a number of times M of the occurrence of boarding zone calls made for the past five minutes as to all the cars is acquired from the storage device (not shown) in the group management control unit 1 (step S21). Then, respective lengths of waiting time (1 to M) for the aforementioned number of times 1 to M are acquired also from the storage device (not shown) in the group management control unit (step S22). Then, an average length of waiting time for the number of times M is calculated as (the sum of the lengths of waiting time (1 to M))/M (step S23). It is then determined whether or not the average length of waiting time is equal to or longer than 0 second and shorter than 20 seconds (step S24). When the average length of waiting time is equal to or longer than 0 second and shorter than 20 seconds, the service state is set as a very good state (step S25). When the average length of waiting time is not equal to or longer 0 second or shorter than 20 seconds, it is then determined whether or not the average length of waiting time is equal to or longer than 20 seconds and shorter than 25 seconds (step S26). When the average length of waiting time is equal to or longer than 20 seconds and shorter than 25 seconds, the service state is set as a good state (step S27). When the average length of waiting time is not equal to or longer than 20 seconds or shorter than 25 seconds in step S26, it is then determined whether or not the average length of waiting time is equal to or longer than 25 seconds and shorter than 30 seconds (step S29). When the average length of waiting time is equal to or longer than 25 seconds and shorter than 30 seconds, the service state is set as a normal state (step S28). When the average length of waiting time is not equal to or longer than 25 seconds or shorter than 30 seconds in step S28, it is then determined whether or not the average length of waiting time is equal to or longer than 30 seconds (step S30). When the average length of waiting time is equal to or longer than 30 seconds, the service state is set as a deteriorated state (step S31). When the average length of waiting time is not equal to or longer than 30 seconds in step S30, the processing is ended.

As described above, the service state detecting means (1B2) performs the aforementioned (III) "waiting time length detecting operation" and the aforementioned (IV) "service state detecting operation" to generate information on the service state in the entire building.

(V) Next, the guidance display operation will be described. The guidance display means (1B3) causes the guidance display unit 4 to display the information on the degree of crowdedness and the information on the service state, which have been acquired as described above. The contents displayed by the guidance display unit 4 are updated as soon as the information on the degree of crowdedness or the information on the service state is updated.

Figure 4:
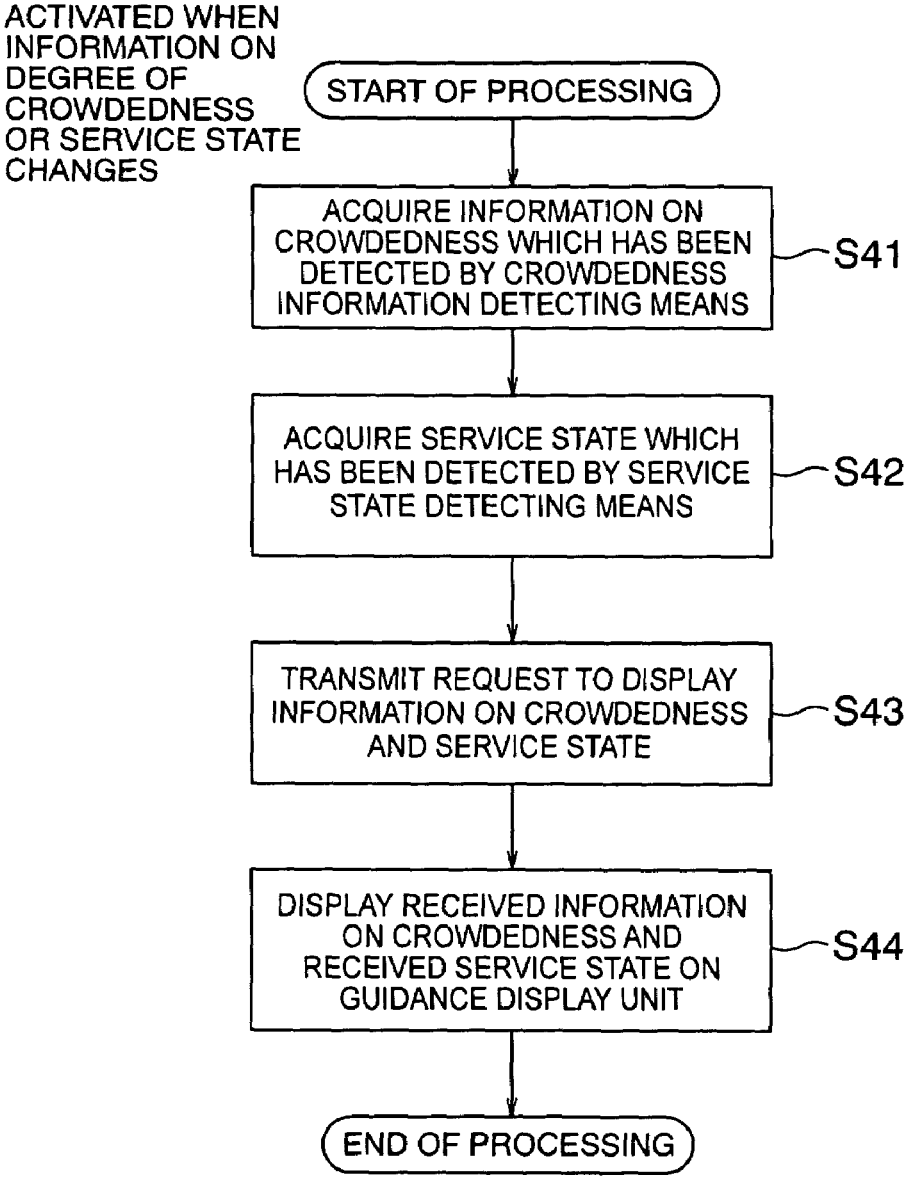
FIG. 4 is a flowchart showing the flow of a processing of a guidance display operation in the elevator control apparatus according to the present invention.

A more detailed description will be given with reference to FIG. 4. FIG. 4 is a flowchart showing the flow of the aforementioned guidance display operation. This processing is activated as soon as at least one of the information on the degree of crowdedness and the service state changes.

As shown in FIG. 4, first of all, the information on the degree of crowdedness which has been detected by the crowdedness information detecting means (1B1) is acquired (step S41). Then, the information on the service state which has been detected by the service state detecting means (1B2) is acquired (step S42). Then, a request to display the acquired information on the degree of crowdedness and the acquired information on the service state is transmitted to the guidance display unit 4 (step S43). The guidance display unit 4 displays the received information on the degree of crowdedness and the received service state on a screen thereof (step S44).

(VI) Finally, examples of guidance display in the guidance display unit 4 will be described.

Figure 5:
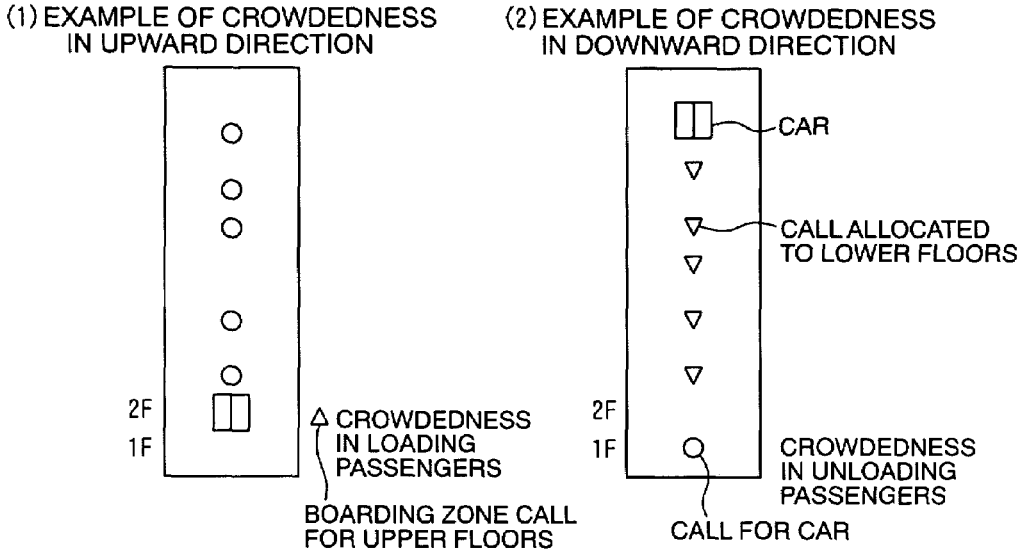
FIG. 5 is an explanatory diagram showing (1) an example of crowdedness in an upward direction and (2) an example of crowdedness in a downward direction in the elevator control apparatus according to the present invention.

FIG. 5 is an explanatory diagram showing (1) an example of crowdedness in the upward direction and (2) an example of crowdedness in the downward direction.

Figure 6:
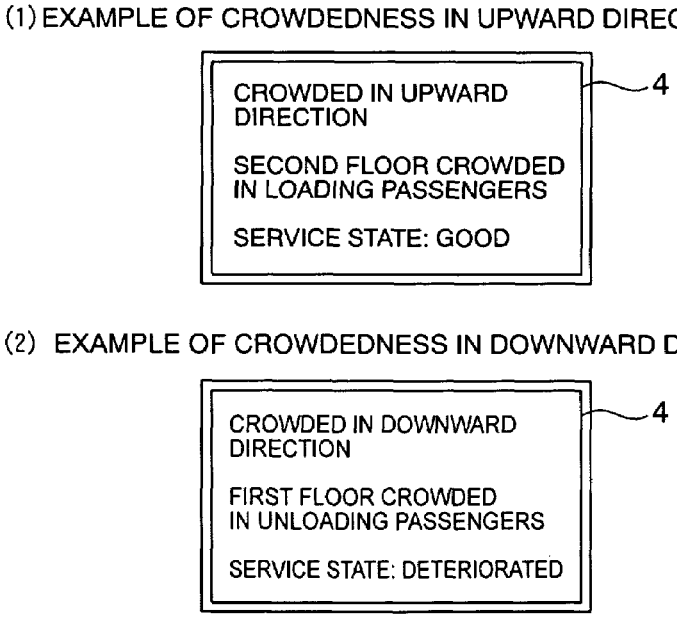
FIG. 6 is an explanatory diagram showing (1) an example of a display in the case of crowdedness in the upward direction and (2) an example of a display in the case of crowdedness in the downward direction in a guidance display unit of the elevator control apparatus according to the present invention.

First of all, the case of (1) crowdedness in the upward direction will be described. As shown in FIG. 5 (1), in the case of, for example, an office building whose second floor is used as a main floor, passengers gather on the second floor in coming to work etc., so many car calls for upper floors are made (it is assumed in this example that the second floor is the most crowded). In the case where the passenger loading load is equal to or larger than 30% and the car load in closing the door (in departing) is equal to or larger than 70% for a UP boarding zone call made on the second floor, "a state of crowdedness" is recognized to have been established. In the case where all the UP boarding zone calls made on the second floor for the past three times indicate "the state of crowdedness", the information on the degree of crowdedness is determined as "crowdedness in the upward direction and crowdedness in loading passengers on the second floor" (by the crowdedness information detecting means (1B1)). This information is displayed by the guidance display means 4 as shown in FIG. 6 (1). In the case where the average of the lengths of waiting time aggregated by the service state detecting means (1B2) for the past five minutes is 23 seconds, the service state is set as a "good" state, which is displayed by the guidance display unit 4 as shown in FIG. 6 (1).

Next, the case of (2) crowdedness in the downward direction will be described. As shown in FIG. 5 (2), in the case of, for example, an office building whose first floor is used as a main floor, many DN calls are made on upper floors, so many passengers get off on the first floor in going home etc. (it is assumed in this example that the first floor is most crowded). In the case where the car load in opening the door (at the time of arrival) is equal to or larger than 70% and the passenger unloading load is equal to or larger than 30% when the passengers arrive at the first floor, "a state of crowdedness" is recognized to have been established. In the case where all the cars traveling in the DN direction that arrived at the first floor for the past three times are "crowded", the information on the degree of crowdedness is determined as "crowdedness in the downward direction and crowdedness in unloading passengers on the first floor" (by the crowdedness information detecting means (1B1)). This information is displayed by the guidance display means 4 as shown in FIG. 6 (2). When the average of the lengths of waiting time aggregated by the service state detecting means (1B2) for the past five minutes is 32 seconds, the service state is set as a "deteriorated" state, which is displayed by the guidance display unit 4 as shown in FIG. 6 (2).

As described above, according to the present invention, the guidance display unit 4 for displaying information on the elevators is installed in each boarding zone to display information on the current degree of crowdedness in the entire building (crowded traveling direction(s) and crowded floor(s)) and information on the service state in the entire building (the service state based on the average length of waiting time in the entire building). Thus, passengers can understand and grasp the operational states of the elevators in the entire building visually and intuitively. By understandably displaying for guidance the operational states of the elevators in the entire building in this manner, customers waiting for the elevators can make predictions to some extent, so their irritation can be allayed.

When the operation of one of the cars is stopped or delayed for some reason while the other cars are in normal operation, namely, when the length of waiting time for one of the cars is longer than the lengths of waiting time for the other cars by a predetermined length of time or more, the guidance display unit 4 may display a message for urging the customers waiting for the elevators to move to the other cars.

The invention claimed is:

1. An elevator control apparatus in a building in which a plurality of elevators are installed comprising:

crowdedness information detecting means for detecting states of crowdedness in boarding zones on respective floors and in respective traveling directions as to all the elevators and generating information on a degree of crowdedness in the entire building based on the states of crowdedness in the boarding zones;

service state detecting means for measuring lengths of waiting time for boarding zone call registrations in all the elevators, calculating an average of the lengths of waiting time, and generating information on a service state in the entire building based on the average; and guidance display means for displaying the information on the degree of crowdedness and the information on the service state.

2. The elevator control apparatus according to claim 1, wherein the states of crowdedness in the boarding zones include a car load in opening a door, a car load in closing a door, a passenger unloading load, and a passenger loading load.

3. The elevator control apparatus according to claim 2, wherein the crowdedness information detecting means determines the information on the degree of crowdedness as "crowdedness in an upward direction and crowdedness in unloading passengers on an N-th floor" when there has been established a state in which the car load in opening the door is equal to or larger than a first threshold and the passenger unloading load is equal to or larger than a second threshold a predetermined number of times or more times in a row in the upward direction and on the N-th floor, determines the information on the degree of crowdedness as "crowdedness in a downward direction and crowdedness in unloading passengers on the N-th floor" when there has been established a state in which the car load in opening the door is equal to or larger than the first threshold and the passenger unloading load is equal to or larger than the second threshold a predetermined number of times or more times in a row in the downward direction and on the N-th floor, determines the information on the degree of crowdedness as "crowdedness in the upward direction and crowdedness in loading passengers on the N-th floor" when there has been established a state in which the car load in closing the door is equal to or larger than a third threshold and the passenger loading load is equal to or larger than a fourth threshold a predetermined number of times or more times in a row in the upward direction and on the N-th floor, and determines the information on the degree of crowdedness as "crowdedness in the downward direction and crowdedness in loading passengers on the N-th floor" when there has been established a state in which the car load in closing the door is equal to or larger than the third threshold and the passenger loading load is equal to or larger than the fourth threshold a predetermined number of times or more times in a row in the downward direction and on the N-th floor, on an assumption that N is equal to or larger than a number indicating a lowermost floor and equal to or smaller than a number indicating an uppermost floor.

4. The elevator control apparatus according to claim 1, wherein the service state detecting means sets the information on the service state as a very good state when the average is equal to or larger than 0 and smaller than a fifth threshold, sets the information on the service state as a good state when the average is equal to or larger than the fifth threshold and smaller than a sixth threshold, sets the information on the service state as a normal state when the average is equal to or larger than the sixth threshold and smaller than a seventh threshold, and sets the information on the service state as a deteriorated state when the average is equal to or larger than the seventh threshold.

* * * * *